US008425182B2

(12) United States Patent
Higashimori et al.

(10) Patent No.: US 8,425,182 B2
(45) Date of Patent: Apr. 23, 2013

(54) RADIAL TURBINE

(75) Inventors: Hirotaka Higashimori, Nagasaki (JP); Masayuki Kawami, Minato-ku (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 13/392,609

(22) PCT Filed: Apr. 1, 2011

(86) PCT No.: PCT/JP2011/058418

§ 371 (c)(1),
(2), (4) Date: Feb. 27, 2012

(87) PCT Pub. No.: WO2012/077365

PCT Pub. Date: Jun. 14, 2012

(65) Prior Publication Data

US 2012/0163966 A1 Jun. 28, 2012

(30) Foreign Application Priority Data

Dec. 7, 2010 (JP) ..... 2010-272765

(51) Int. Cl.
*F01D 5/04* (2006.01)
*F01D 1/08* (2006.01)
*F01D 5/14* (2006.01)

(52) U.S. Cl.
USPC ..... 415/157; 415/156; 415/184; 415/206; 415/224.5; 416/185; 416/186 R; 416/231 R

(58) Field of Classification Search ..... 415/157, 415/158, 184, 203, 204, 205, 206, 224.5; 416/181, 185, 186 R, 231 R
See application file for complete search history.

(56) References Cited

U.S. PATENT DOCUMENTS 3,614,259 A * 10/1971 Neff ..... 415/205
4,544,326 A * 10/1985 Nishiguchi et al. ..... 415/151

(Continued)

FOREIGN PATENT DOCUMENTS

DE 10 2005 019 937 5/2006
DE 10 2005 019 937 B3 5/2006

(Continued)

OTHER PUBLICATIONS

Partial English translation of International Search Report issued Jun. 21, 2011 in corresponding International Application No. PCT/JP2011/058418.

(Continued)

*Primary Examiner* — Igor Kershteyn
(74) *Attorney, Agent, or Firm* — Wenderoth, Lind & Ponack, L.L.P.

(57) ABSTRACT

An expansion turbine with a radial turbine wheel has a main path that gradually increases in height and axially discharges fluid while swirling from a main inlet located at the outer circumferential side into the main path, with a radial flow as a main component, the radial turbine wheel has a sub-path branching off from the side of a hub of the main path at a position radially inward of the main inlet and extending rearward from the main path, the sub-path has, at an outer circumferential end, a sub-inlet located at a position in the radial direction different from the main inlet and supplied with a fluid having a pressure different from the pressure of the fluid supplied through the main inlet, the main inlet and the sub-inlet are partitioned by a back plate portion, in which the gap between it and the main path or the sub-path is adjusted.

5 Claims, 5 Drawing Sheets

U.S. PATENT DOCUMENTS

| | | | | |
|---|---|---|---|---|
| 6,216,459 | B1 * | 4/2001 | Daudel et al. | 60/605.2 |
| 6,672,061 | B2 * | 1/2004 | Schmid et al. | 60/605.2 |
| 2007/0180826 | A1 | 8/2007 | Sumser et al. | |

FOREIGN PATENT DOCUMENTS

| | | |
|---|---|---|
| JP | 56-135718 | 10/1981 |
| JP | 58-114844 | 8/1983 |
| JP | 61-3996 | 1/1986 |
| JP | 1-277627 | 11/1989 |
| JP | 1-285607 | 11/1989 |
| JP | 2007-192129 | 8/2007 |
| JP | 2008-503685 | 2/2008 |

OTHER PUBLICATIONS

Notification of Grant of Invention Patent issued Jan. 31, 2013 in corresponding Chinese Application No. 201180003542.9 (with English translation).

* cited by examiner

RADIAL TURBINE

TECHNICAL FIELD

The present invention relates to a radial turbine.

BACKGROUND ART

A radial turbine is equipped with a single turbine wheel that converts swirling energy of the flow of a swirling fluid having a radial flow component as a main component and flowing into a turbine wheel to a rotational motive force and that discharges the flow that has released its energy, in an axial direction. The radial turbine converts the energy of a low/medium- or high-temperature, high-pressure fluid to a rotational motive force and is used to recover the motive force of exhausted energy of a high-temperature, high-pressure fluid exhausted from various kinds of industrial plant. Radial turbines are also used in exhaust heat recovery of systems that acquire a motive force via a heat cycle, such as power sources for ships and cars. Radial turbines are also widely used to recover a motive force in binary-cycle power generation or the like that uses a low/medium-temperature heat source, such as geothermal or OTEC.

If the various energy sources have a plurality of pressures, a plurality of turbines are used, that is, one turbine is used for one pressure source, as disclosed in PTL 1. Alternatively, two turbine wheels are sometimes provided coaxially.

This is because, turbines, for example, radial turbines, are designed for optimum conditions for the individual fluid pressures. For example, the inlet radius R of a radial turbine depends on the relation, $g \cdot H \approx U$ 2, where g is gravitational acceleration, H is the head, and U is the turbine-wheel-inlet circumferential speed. That is, if we let the rotational speed of the turbine wheel be N (rpm), the inlet radius R is set at a value near to $R \approx U/2 \cdot \pi/(N/60)$.

A known example of a radial turbine that handles a fluid having a strongly fluctuating flow rate has one inlet channel partitioned by a dividing wall, as disclosed in PTL 2. This is configured such that one of the inlet channels supplies fluid to the hub side of the blades.

In this case, however, both of the inlet channels handle fluids with the same pressure. Furthermore, since the inlet channels are provided next to each other and are simply partitioned by the dividing wall, if fluids with different pressures are handled, a higher-pressure fluid flows toward a lower-pressure fluid, decreasing the turbine efficiency.

CITATION LIST

Patent Literature

{PTL 1} Japanese Unexamined Patent, Application Publication No. Hei 1-285607

{PTL 2} Japanese Translation of PCT International Application, Publication No. 2008-503685

SUMMARY OF INVENTION

Technical Problem

A system that uses a plurality of radial turbines requires a high production cost and installation space.

Furthermore, coaxially providing a plurality of turbine wheels increases the number of components of the turbines, complicates the structure, and increases the production cost.

In consideration of such circumstances, an object of the present invention is to provide a radial turbine that handles fluids having a plurality of pressures with a single or integrated turbine wheel, thereby decreasing the number of components, and thus achieving low cost.

Solution to Problem

To solve the above problem, the present invention adopts the following solutions.

The present invention is a radial turbine equipped with a turbine wheel having a main path that gradually increases in blade height while curving from a radial direction to an axial direction, the turbine wheel converting swirling energy of fluid that flows therein while swirling from a main inlet located at the outer circumferential side into the main path, with a radial flow as a main component, to a rotational motive force and axially discharging the fluid that has released the swirling energy, wherein the turbine wheel has a sub-path branching off and extending from the hub surface of the main path, the sub-path being located at a position radially inward of the main inlet and rearward of the main path; the sub-path has a sub-inlet that is located at a position in the radial direction different from the main inlet and at an outer circumferential end of the sub-path, and that is supplied with a fluid with a pressure different from the pressure of the fluid supplied through the main inlet; and the main inlet and the sub-inlet are partitioned by a gap adjusted between a back plate and a casing of the turbine wheel that constitute the main path.

According to the present invention, the fluid is introduced through the main inlet to an outer circumferential end of the main path of the turbine wheel. The fluid introduced through the main inlet passes through the main path that gradually increases in blade height while curving from a radial direction to an axial direction, where the pressure is gradually decreased, and is discharged from the turbine wheel, causing a rotating shaft to which the turbine wheel is mounted to generate a motive force.

A fluid with a pressure different from the pressure of the fluid supplied through the main inlet is guided through the sub-inlet to the outer circumferential end of the sub-path. This fluid is supplied through the sub-path and the hub surface of the main path to the main path, where it is mixed with the fluid introduced through the main inlet. The mixed fluid flows out from the turbine wheel while gradually decreasing in pressure, causing the rotating shaft to which the turbine wheel is mounted to generate a motive force.

In this case, preferably, the sub-inlet is disposed at a radial position where the pressure of the fluid to be mixed therewith is substantially the same.

Since the main inlet and the sub-inlet are partitioned by a gap adjusted between the back plate and the casing of the turbine wheel that constitute the main path, they are separated clearly, so that leakage of the fluid can be reduced.

Thus, by supplying fluids with a plurality of pressures, a rotational motive force can be extracted by a single turbine wheel. This allows the number of components to be decreased, thus reducing the production cost.

"Radial turbine" in the present invention refers to a turbine that processes fluid that flows in with a radial flow as a main component, that is, fluid whose radial speed component at the inlet of the turbine wheel is larger than at least an axial speed component. Accordingly, in the structure of the turbine wheel, the concept of the radial turbine includes a so-called radial turbine in which the hub surface at the wheel inlet is formed of a surface substantially perpendicular to the rotating shaft, a radial turbine in which the hub surface is inclined with respect to the rotating shaft, and a so-called mixed flow turbine in which the hub surface is inclined with respect to the rotating shaft, and the blade leading edge is inclined with respect to the rotating shaft.

The fluids introduced to the main inlet and the sub-inlet may be swirled using nozzles or a scroll constituted by a plurality of vanes disposed at certain intervals in the circumferential direction.

In a first aspect of the present invention, the sub-path is formed such that blades that form the main path extend across the back plate. In other words, a circumferential wall that constitutes the sub-path and that works as the blades of the sub-path is formed such that the blades that constitute the main path are extended in the direction of the hub.

With this configuration, since the blades that constitute the main path and the blades that constitute the sub-path are constituted by the same blades at the turbine wheel outlet, the main path and the sub-path are continuously formed, which allows fluids passing through the paths to be smoothly mixed.

In a second aspect of the present invention, the sub-inlet is inclined with respect to the rotating shaft.

In the case where the sub-inlet is configured to be substantially parallel to the rotating shaft, a fluid introduced through the sub-inlet moves in the radial direction, and thus, the fluid needs to be turned to the axial direction to meet the main path.

In the second aspect of the present invention, since the sub-inlet is inclined with respect to a rotating shaft, the fluid introduced through the sub-inlet has an axial speed component from the time of introduction. Since this can decrease the size of the portion for turning the flow in the axial direction as compared with the sub-inlet extending along the rotating shaft, the axial length of the turbine wheel can be decreased.

In a third aspect of the present invention, the sub-path is constituted by a plurality of through-channels provided at a position corresponding to the main path so as to pass through the hub of the turbine wheel in the axial direction and a second turbine wheel disposed at the upstream side of the through-channels.

When forming the main path and the sub-path by a single blade, the shape of the blade may be complicated. Considering turbine efficiency, it is conceivable that the blade has a three-dimensional structure. In this case, because machining using a ball end mill or the like is sometimes difficult, the turbine wheel is manufactured by casting. In manufacturing by casting, because it is difficult to smooth the surface roughness of the path as in machining, the flow resistance of fluid may increase, thus reducing the efficiency of the turbine.

In the third aspect of the present invention, since the sub-path is formed of the through-channels provided so as to pass through the hub of the turbine wheel and the second turbine wheel disposed at the upstream side of the through-channels, the structure according to the above aspect is divided into two. Accordingly, the configuration of the turbine wheel can be substantially the same as the configuration of a general turbine wheel in the related art, and thus, the turbine wheel can be manufactured by machining, as in the related art. Since the through-path is a substantially straight, rectangular duct-shaped space, it can easily be processed from the back of the turbine wheel with a ball end mill or the like. Since the second turbine wheel has a relatively simple blade shape, it can easily be manufactured by machining, as in the related art.

Since all the components constituting the turbine can be manufactured by machining, the surface roughness of the main path and the sub-path can be smoothed out by machining as compared with a turbine manufactured by casting, thus preventing a decrease in the efficiency of the turbine.

In a fourth aspect of the present invention, the second turbine wheel is fixedly mounted to the turbine wheel.

This allows the surfaces of the blades of the second turbine wheel to be smoothly connected at the joints of the circumferential wall surfaces of the through-paths working as the blade surfaces of the turbine wheel and the blades of the second turbine wheel.

Advantageous Effects of Invention

According to the present invention, since the turbine wheel has a sub-path branching off from the hub surface of the main path at a position radially inward of the main inlet and extending to the back side of the turbine wheel, and the sub-path has, at an outer circumferential end, a sub-inlet which is located at a position in the radial direction different from the main inlet and which is supplied with a fluid having a pressure different from the pressure of the fluid supplied through the main inlet, a rotational motive force can be extracted by a single or integrated turbine wheel by supplying fluids with a plurality of pressures. This can reduce the number of components, thus reducing the production cost.

DESCRIPTION OF EMBODIMENTS

Embodiments of the present invention will be described in detail using the drawings.

First Embodiment

An expansion turbine (radial turbine) 1 according to a first embodiment of the present invention will be described hereinbelow with reference to FIGS. 1 to 3.

Figure 1:
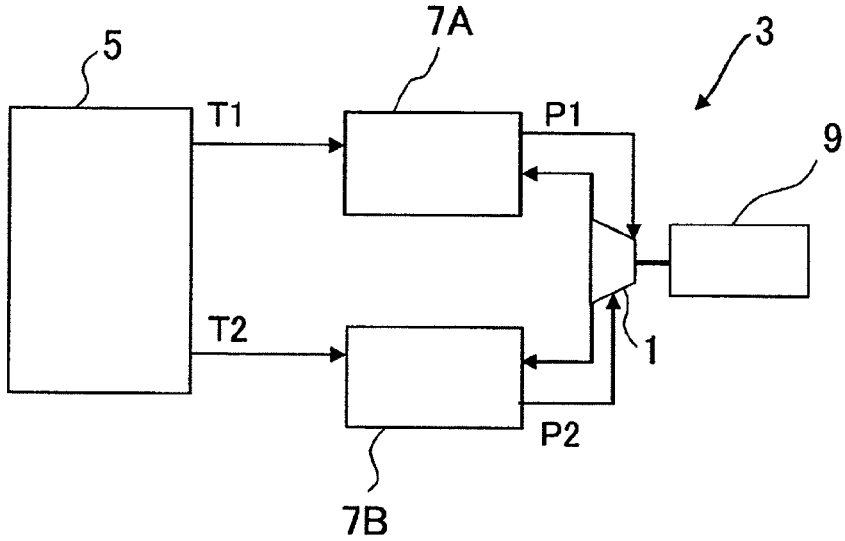
FIG. 1 is a block diagram showing the configuration of a binary power generation system in which an expansion turbine according to a first embodiment of the present invention is used.

FIG. 1 is a block diagram showing the configuration of a binary power generation system in which the expansion turbine according to the first embodiment of the present invention is used. FIG. 2 is a partial sectional view of a radial turbine 100 applied to the expansion turbine 1 in FIG. 1. FIG.

Figure 2:
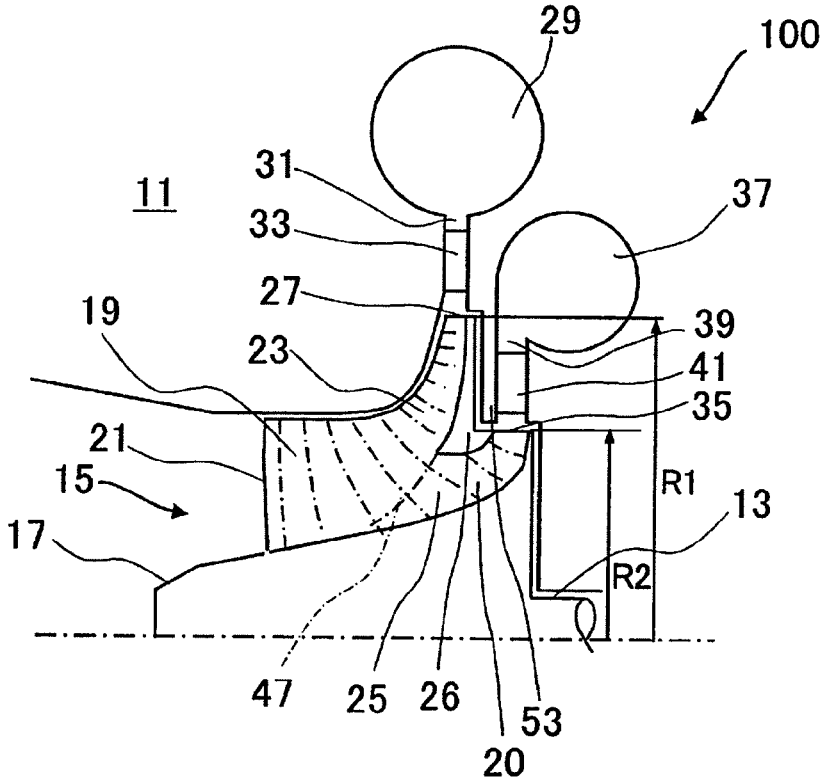
FIG. 2 is a partial sectional view of a radial turbine applied to the expansion turbine in FIG. 1.

3 is a drawing of the blades in FIG. 2 projected onto a cylindrical surface, as viewed from the radially outer side.

A binary power generation system 3 is used, for example, as a system for geothermal power generation. The binary power generation system 3 is equipped with a heat source unit 5 having a plurality of heat sources, two binary cycles 7A and 7B, the expansion turbine 1, and a generator 9 that generates electric power using the rotational motive force of the expansion turbine 1.

The heat source unit 5 supplies vapor or hot water heated by geothermal energy to the binary cycles 7A and 7B. The heat source unit 5 is configured to supply two kinds of vapor or hot water, T1 and T2, with different temperatures.

The binary cycles 7A and 7B are constituted by a Rankine cycle that circulates a low-boiling-point medium (fluid) serving as a working fluid. Examples of the low-boiling-point medium include an organic medium, such as isobutane, CFCs, CFC substitutes, ammonia, and a fluid mixture of ammonia and water.

In the binary cycles 7A and 7B, a low-boiling-point medium is heated to a high-pressure fluid by high-temperature vapor or hot water supplied from the heat source unit 5 and is supplied to the expansion turbine 1. The low-boiling-point medium exhausted from the expansion turbine 1 is returned to the binary cycles 7A and 7B, where it is heated again by the high-temperature vapor or hot water, and the process is repeated in sequence.

During this process, the two binary cycles 7A and 7B use the same low-boiling-point media. Since the temperatures of the high-temperature vapor or hot water supplied to the binary cycles 7A and 7B differ, the pressures P1 and P2 of the low-boiling-point media supplied therefrom to the expansion turbine 1 differ. A case where the pressure P1 is higher than the pressure P2 will be described hereinbelow.

The radial turbine 100 is equipped with a casing 11, a rotating shaft 13 that is supported so as to be rotatable in the casing 11, and a radial turbine wheel 15 mounted to the outer circumference of the rotating shaft 13.

The radial turbine wheel 15 is constituted by a hub 17 mounted to the outer circumferential surface of the rotating shaft 13 and a plurality of blades 19 provided around the outer circumferential surface of the hub 17, spaced apart from each other in a radiating pattern in the circumferential direction.

A main inlet 27 that is substantially parallel to the rotating shaft 13 is formed at a position of a radius R1 around the whole circumference of the radial turbine wheel 15 at the outer circumferential end thereof. An inlet channel 31, which is a ring-shaped space, is formed at the outer circumferential side of the main inlet 27. A main inflow path 29 to which the low-boiling-point medium with the pressure P1 supplied from the binary cycle 7A is introduced is connected to an outer circumferential end of the inlet channel 31.

The inlet channel 31 is provided with nozzles 33 constituted by a plurality of vanes disposed at certain intervals in the circumferential direction.

The radial turbine wheel 15 is provided with a main path 23 that curves from the radial direction to the axial direction so that the flow flows out from the main inlet 27 toward a turbine wheel outlet 21.

The main path 23 is provided with a sub-path 25 extending rearward. Flows in the main path 23 and the sub-path 25 meet at a confluence portion 47, which is an imaginary line of the hub surface of the main path 23 and which is indicated by a one-dot chain line. In other words, the sub-path 25 is formed so as to branch off from the confluence portion 47 and extend rearward from the main path 23.

A sub-inlet 35 extending around the whole circumference at a position of a radius R2 different from that of the main inlet 27 is formed at an outer circumferential end at the back of the sub-path 25.

An inlet channel 39, which is a ring-shaped space, is formed at the outer circumferential side of the sub-inlet 35 disposed at the position of the radius R2. A sub inflow path 37 to which the low-boiling-point medium with the pressure P2 supplied from the binary cycle 7B is introduced is connected to an outer circumferential end of the inlet channel 39.

The inlet channel 39 is provided with nozzles 41 constituted by a plurality of vanes disposed at certain intervals in the circumferential direction.

The main inlet 27 and the sub-inlet 35 are disposed so as to be substantially parallel to the rotating shaft 13.

The radius R1 of the main inlet 27 and the radius R2 of the sub-inlet 35 are set as follows, where U1 is the turbine-wheel-inlet circumferential speed of the main inlet 27, and U2 is the turbine-wheel-inlet circumferential speed of the sub-inlet 35. The relations, $g \cdot H1 \approx U12$ and $g \cdot H2 \approx U22$, hold with respect to the individual inlet pressures P1 and P2 and heads H1 and H2, respectively. If we let the rotational speed of the radial turbine wheel 15 be N (rpm), the radius R1 of the main inlet 27 and the radius R2 of the sub-inlet 35 are set at values close to $R1 \approx U1/2 \cdot \pi/(N/60)$ and $R2 \approx U2/2 \cdot \pi/(N/60)$, respectively.

Since the pressure P2 is lower than the pressure P1, the sub-inlet 35 is located at a position where the radius R2 thereof is smaller than the radius R1 of the main inlet 27.

The sub-path 25 meets the main path 23 at the confluence portion 47, where a flow G1 flowing in the main path 23 and a flow G2 flowing in the sub-path 25 are mixed and flow out through the turbine wheel outlet 21. The turbine wheel outlet 21 has a trailing edge following substantially in the radial direction. The trailing edge may be inclined so that the flow flows out with a radially inward component.

The blades 19 of the radial turbine wheel 15 are each provided with a branch path wall 20 that branches at the confluence portion 47 to partition the sub-path 25 in the circumferential direction. A back plate 26 is provided at the back of the blades 19 extending from the main inlet 27 to the confluence portion 47 and at the shroud side of the branch path wall 20. The main path 23 is formed by the adjacent blades 19, the hub 17, the back plate 26, and the casing 11. The sub-path 25 is formed by the branch path walls 20 of the adjacent blades 19, the hub 17, and the radially inward surface of the back plate 26.

Figure 3:
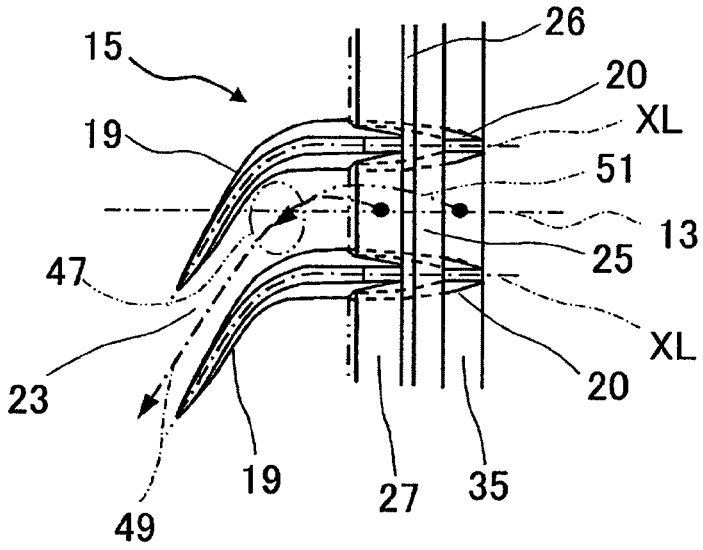
FIG. 3 is a drawing of the blades in FIG. 2 projected onto a cylindrical surface, as viewed from the radially outer side.

As shown in FIG. 3, the blades 19 have a radial blade shape with substantially the same angle with respect to the rotating shaft 13 at the main inlet 27, in which the center line XL of each blade expands parabolically toward the turbine wheel outlet 21 of the radial turbine wheel 15 with respect to the rotating shaft 13. The turning point is in the vicinity of the confluence portion 47.

The branch path walls 20 are disposed at positions where the blades 19 located at the confluence portion 47 extend toward the hub and are configured such that the angles thereof are substantially the same as those of the blades 19 at the main inlet portion to receive the centrifugal forces of the main inlet portion, which is the main inlet 27 side portion of the blades 19, and the back plate 26. Therefore, the branch path walls 20 have a radial blade shape having substantially the same angle with respect to the rotating shaft 13.

In the case where the stress that acts on the branch path walls 20 due to the centrifugal force of the blades 19 is sufficiently small, the angles of the main inlet portions of the blades 19 and the angles of the branch path walls 20 may differ.

The main path 23 and the sub-path 25 are configured so that both the height of the blades 19 in the main path 23 and the height of the branch path wall 20 in the sub-path 25 increase with decreasing distance to the turbine wheel outlet 21, and the flow 49 of the low-boiling-point medium flowing in the main path 23 and the flow 51 of the low-boiling-point medium flowing in the sub-path 25 gradually decrease in pressure while increasing in flow volume with decreasing distance to the turbine wheel outlet 21.

FIG. 2 shows the isobaric lines of fluid passing through the radial turbine wheel 15 using one-dot chain lines.

The radius R2 is set so that the pressure of a fluid that is supplied through the sub-inlet 35 and reaches the confluence portion 47 is substantially the same as the pressure of a fluid passing through the confluence portion 47 of the main path 23.

The casing 11 is provided with a casing wall 53 between the main inlet 27 and the sub-inlet 35, one surface of which constitutes the path wall of the inlet channel 39, and the other surface of which is adjusted so that the gap between it and the back plate 26 is small.

The operation of the thus-configured radial turbine 100 according to this embodiment will be described hereinbelow.

A low-boiling-point medium with the pressure P1 supplied from the binary cycle 7A passes through the main inflow path 29 and the inlet channel 31, where the quantity and speed thereof are adjusted by the nozzles 33, and the low-boiling-point medium with the flow rate G1 is supplied through the main inlet 27 to the main path 23. At that time, the pressure of the low-boiling-point medium supplied to the radial turbine wheel 15 is PN1. The low-boiling-point medium with the pressure PN1 flows out of the radial turbine wheel 15 while continuously decreasing in pressure to a pressure Pd at the outlet of the radial turbine wheel 15, causing the rotating shaft 13 to which the radial turbine wheel 15 is mounted to generate a rotational motive force.

At that time, a low-boiling-point medium with the pressure P2 supplied from the binary cycle 7B passes through the sub inflow path 37 and the inlet channel 39, where the quantity and speed thereof are adjusted by the nozzles 41, and the low-boiling-point medium with the flow rate G2 is supplied through the sub-inlet 35 to the sub-path 25. At that time, the pressure PN2 of the low-boiling-point medium supplied through the sub-inlet 35 to the sub-path 25 is decreased while the low-boiling-point medium is flowing through the sub-path 25 to become substantially the same as the pressure at the confluence portion 47 of the main path 23. Since the casing wall 53 is provided between the main inlet 27 and the sub-inlet 35 such that the clearance between it and the back plate 26 of the main path 23 is adjusted to be small, even if low-boiling-point media whose pressures PN1 and pressure PN2 differ at the inlet of the wheel are used, a low-boiling-point medium with a higher pressure flowing through the main inlet 27 can be prevented from leaking toward the sub-inlet 35, thus reducing leakage.

The low-boiling-point medium with the flow rate G2 that has flowed in through the sub-inlet 35 is mixed at the confluence portion 47 with the low-boiling-point medium with the flow rate G1 supplied through the main inlet 27. Since the main path 23 and the sub-path 25 are continuously formed by the blades 19, fluids that pass through these paths can be smoothly mixed.

The mixed low-boiling-point medium is discharged through the turbine wheel outlet 21 of the radial turbine wheel 15. The low-boiling-point medium with a combined flow rate of the flow rate G1 and the flow rate G2 causes the rotating shaft 13 to generate a rotational motive force via the radial turbine wheel 15.

The rotational driving of the rotating shaft 13 causes the generator 9 to generate electric power.

By supplying low-boiling-point media with different pressures flowing from the binary cycles 7A and 7B to the main inlet 27 and the sub-inlet 35, respectively, of the radial turbine wheel 15 in this way, a rotational motive force can be extracted by the single radial turbine wheel 15.

Thus, with the radial turbine 100 according to this embodiment, the number of components can be decreased as compared with a plurality of expansion turbines or an expansion turbine equipped with a plurality of radial turbine wheels, thus decreasing the production cost.

In the first embodiment, although the radial turbine wheel 15 is provided with no shroud, a shroud may be mounted as necessary.

This can reduce leakage loss of the low-boiling-point medium in the main path 23, thus increasing the turbine efficiency.

In the case where the sub-inlet 35 is configured to be substantially parallel to the rotating shaft 13, as in the first embodiment, the low-boiling-point medium introduced through the sub-inlet 35 moves in the radial direction, and thus, the low-boiling-point medium needs to be turned to the axial direction to meet the main path 23.

Figure 4:
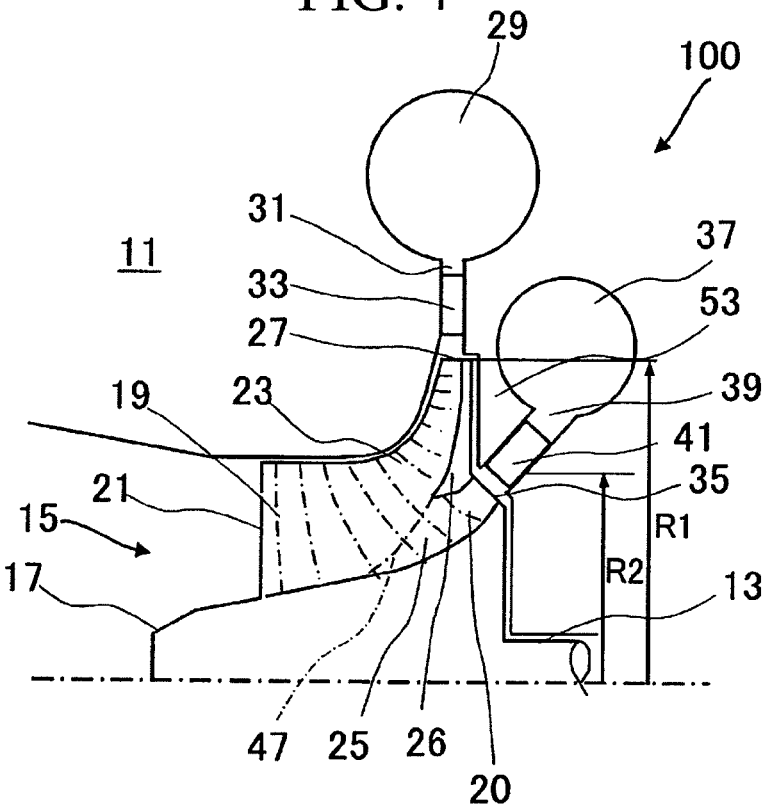
FIG. 4 is a partial sectional view showing another embodiment of the radial turbine according to the first embodiment of the present invention.

In this case, the sub-inlet 35 may be inclined with respect to the rotating shaft, as shown in FIG. 4.

With this structure, since the sub-inlet 35 is inclined with respect to the rotating shaft 13, the low-boiling-point medium introduced through the sub-inlet 35 has an axial speed component from the time of introduction. Since this can decrease the size of the portion for turning the flow in the axial direction as compared with the sub-inlet 35 extending along the rotating shaft 13, the axial length of the sub-path 45 can be decreased, and thus, the expansion turbine 1 can be made more compact.

In the first embodiment, although the radial turbine wheel 15 is configured such that the hub surfaces of the main inlet 27 and the sub-inlet 35 are constituted by surfaces that are substantially perpendicular to the rotating shaft 13, the present invention is not limited thereto. For example, the hub surfaces may be inclined with respect to the rotating shaft 13, and in addition, the blade leading edge may be inclined with respect to the rotating shaft.

In the first embodiment, since the pressure P2 of the low-boiling-point medium introduced through the sub-inlet 35 is lower than the pressure P1 of the low-boiling-point medium introduced through the main inlet 27, the sub-inlet 35 is provided radially inward of the main inlet 27. However, the positional relationship in the radial direction between the sub-inlet 35 and the main inlet 27 is not limited thereto.

Figure 5:
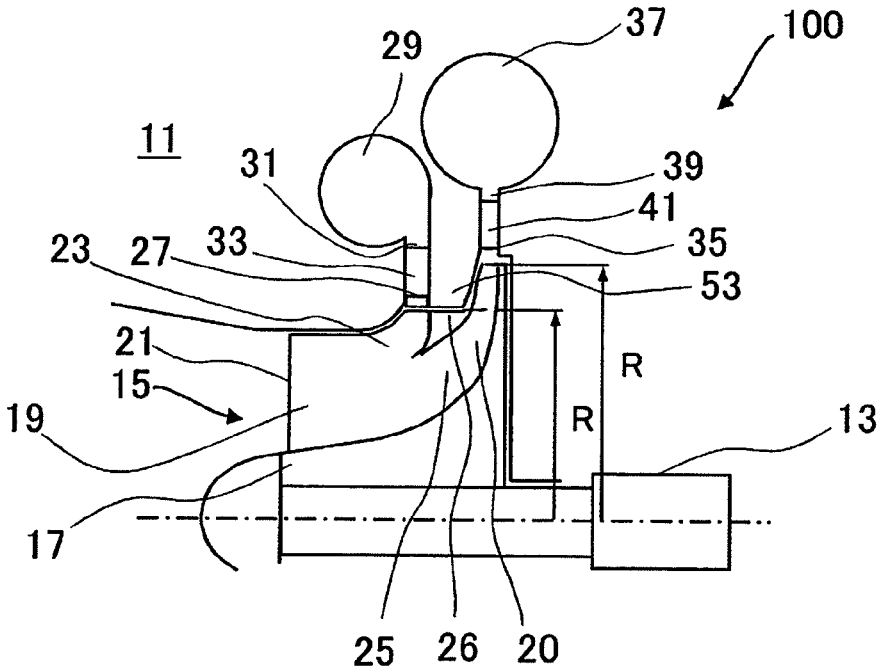
FIG. 5 is a partial sectional view showing another embodiment of the radial turbine according to the first embodiment of the present invention.

For example, if the pressure P2 of the sub-inlet 35 is higher than the pressure P1 of the main inlet 27, the sub-inlet 35 is sometimes provided radially outward of the main inlet 27, as shown in FIG. 5.

In this case, the casing wall 53 is configured such that one surface constitutes a path wall so as to face the outer wall surfaces of the main path 23 and the back plate 26, and the other surface of which is adjusted so that the gap between it and the blade leading edge of the sub-path 25 is small.

Although the first embodiment has been described as applied to the binary power generation system 3 having the two binary cycles 7A and 7B, application of the expansion turbine 1 is not limited thereto.

Figure 6:
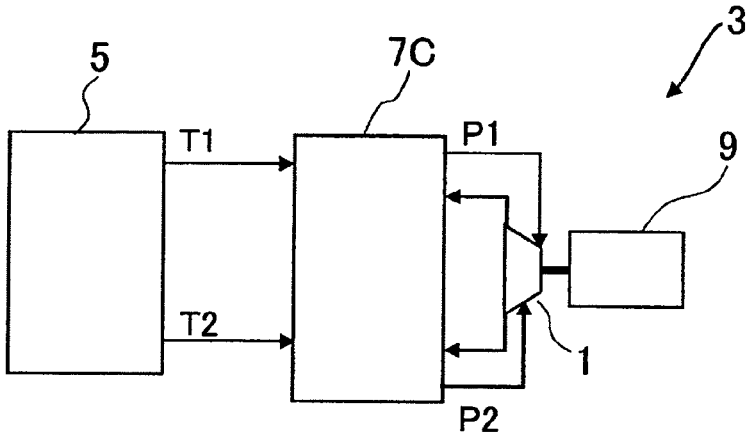
FIG. 6 is a block diagram showing another configuration of a binary power generation system in which the expansion turbine according to the first embodiment of the present invention is used.

For example, as shown ion FIG. 6, the expansion turbine 1 can also be applied to a binary power generation system 3 having one binary cycle 7C. This extracts low-boiling-point media with different pressures from the binary cycle 7C and recovers a motive force with the expansion turbine 1.

Figure 7:
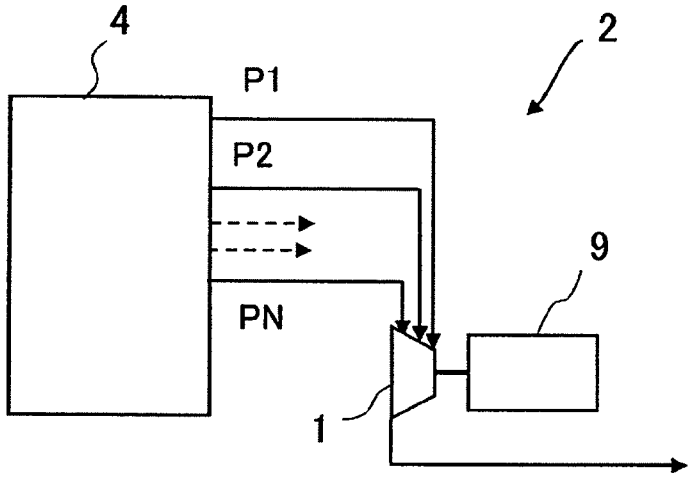
FIG. 7 is a block diagram showing the configuration of a plant system in which the expansion turbine according to the first embodiment of the present invention is used.

Alternatively, the expansion turbine 1 may be used in a plant system 2 shown in FIG. 7. The plant system 2 extracts vapor (fluid) with a plurality of, for example, three, different pressures, using a boiler plant 4 and recovers a motive force with the expansion turbine 1.

Examples of the plant system 2 are various kinds of industrial plant, which may be used in a mixture of processes in which separation or mixing is performed in, for example, a chemical plant.

Second Embodiment

Next, an expansion turbine 1 according to a second embodiment of the present invention will be described using FIG. 8.

Since the second embodiment differs from the first embodiment in the configuration of a method for manufacturing a turbine wheel, the differences will be mainly described here, and duplicate descriptions of the same components as those of the foregoing first embodiment will be omitted.

The same components as those of the first embodiment are given the same reference signs.

Figure 8:
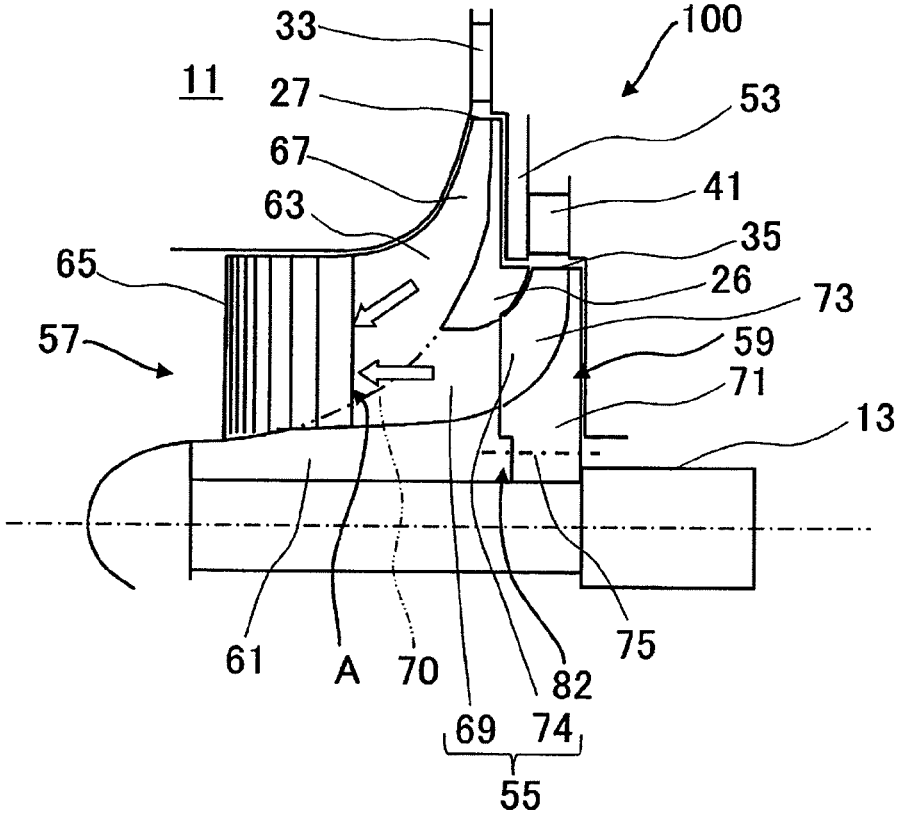
FIG. 8 is a partial sectional view showing a radial turbine according to a second embodiment of the present invention.

FIG. 8 is a partial sectional view showing a radial turbine 100 according to the second embodiment of the present invention.

In this embodiment, a sub-path 55 is formed of a through-path 69 provided in a first radial turbine wheel (turbine wheel) 57 and a path 74 between blades 73, formed in a second radial turbine wheel (second turbine wheel) 59, the turbine wheels being combined in the axial direction.

In other words, the radial turbine wheel 15 in the first embodiment is divided into the first radial turbine wheel 57 and the second radial turbine wheel 59.

The first radial turbine wheel 57 corresponds to the area in the radial turbine wheel 15 of the first embodiment including the back plate 26 of the main path 23 and extending to the turbine wheel outlet 21, and the second radial turbine wheel 59 corresponds to the other area.

The first radial turbine wheel 57 is constituted by a hub 61 mounted to the outer circumference of the rotating shaft 13 and a plurality of blades 63 provided at certain intervals in a radiating pattern around the outer circumference of the hub 61. The blades 63 are configured to gradually increase in height from the main inlet 27 to the turbine wheel outlet 65 and are vertically erected in a straight line in the radial direction at the turbine wheel outlet 65. The turbine wheel outlet 65 may also be configured to be inclined so that the flow is discharged with a radially inward component.

The shapes of the blades 63 projected onto a cylindrical surface are radial blade shapes with substantially the same angle with respect to the rotating shaft 13 at the main inlet 27, in which the center line of each blade expands parabolically toward the turbine wheel outlet 65 of the first radial turbine wheel 57 with respect to the rotating shaft 13. The position where the angle increases starts from the vicinity of position A, as indicated by equidistant lines along the blade surface in FIG. 8. In other words, the blades 63 have the same structure as those of radial blades that are often used in the related art.

Main paths 67 are each formed of the adjacent blades 63, the hub 61, the back plate 26, and the casing 11.

The main inlet 27 extending around the whole circumference is formed at the outer circumferential end of the main path 67, as in the first embodiment, and a low-boiling-point medium with a pressure P1 supplied from the binary cycle 7A is introduced therein.

The hub 61 is provided with a plurality of through-paths 69 extending from the back plate 26 to the main paths 67 at certain intervals in the circumferential direction, at positions corresponding to the individual main paths 67.

The through-paths 69 are substantially straight, rectangular duct-shaped spaces, whose longitudinal direction is substantially in the axial direction. The through-paths 69 individually open to the main paths 67 along a hub imaginary line 70, which indicates the extension of the hub surface where the blades 63 are not present.

The second radial turbine wheel 59 is constituted by a hub 71 mounted on the outer circumference of the rotating shaft 13 and the plurality of blades 73 provided at certain intervals in a radiating pattern around the outer circumferential surface of the hub 71.

The blades 73 are configured to gradually increase in height from the sub-inlet 35 toward the downstream side and are vertically erected in a straight line in the radial direction at the outlet. The path 74 formed by adjacent blades 73, the hub 71, and the inner circumferential surface of the back plate 26 increases in height toward the downstream side. The blades 73 are formed at positions where the paths 74 are communicated with the through-paths 69. Thus, the path 74 and the through-path 69 constitute an integrated path, that is, the sub-path 55.

The hub 71 is configured to be combined with the hub 61 by means of a mating portion 82 and is disposed at a predetermined position. This can ensure the concentricity of the hub 71 and the hub 61. By using, for example, a fitting structure for the rotating shaft 13, the hub 73 need not use the mating portion 82.

The hub 71 is fixedly mounted to the hub 61 with bolts 75. Thus, the second radial turbine wheel 59 is firmly mounted at a predetermined position on the first radial turbine wheel 57 and is integrated therewith.

The sub-inlet 35 extending around the whole circumference is formed at the outer circumferential end of the blades 73, as in the first embodiment, to which a low-boiling-point medium with pressure P2 supplied from the binary cycle 7B is introduced.

The number of blades 73 is set to be the same as that of the radial blades 63. The surfaces of the blades are smoothly connected at the joints of the circumferential wall surfaces of the blades 73 of the second radial turbine wheel 59 and the through-paths 69 working as the blade surfaces of the first radial turbine wheel 57. Because this eliminates a level difference in the structure and a leading edge opposing the flow at a portion where the low-boiling-point medium flows from the second radial turbine wheel 59 to the first radial turbine wheel 57, the low-boiling-point medium flows smoothly from the second radial turbine wheel 59 to the channel in the first radial turbine wheel 57.

Note that the number of radial blades 73 and the number of radial blades 63 may differ.

Since the configuration of the first radial turbine wheel 57 can be substantially the same as the configuration of a general radial turbine wheel used in the related art, the first radial turbine wheel 57 can be manufactured by machining as in the related art. Since the through-path 69 is a substantially straight, rectangular duct-shaped space, it can easily be processed from the back of the first radial turbine wheel 57 with a ball end mill or the like. Since the second radial turbine wheel 59 has a relatively simple blade shape, it can easily be manufactured by machining as in the related art.

This allows the surface roughness of the main paths 67 and the sub-paths 55 to be smoothed out by machining, thus preventing a decrease in the efficiency of the expansion turbine 1.

Since the operation of the thus-configured radial turbine 100 according to the second embodiment is basically the same as that of the first embodiment, it will be simply described here.

The low-boiling-point medium with the pressure P1 supplied from the binary cycle 7A is adjusted in quantity and speed by the nozzles 33, and the low-boiling-point medium with the flow rate G1 is supplied through the main inlet 27 to the main paths 67.

On the other hand, the low-boiling-point medium with the pressure P2 supplied from the binary cycle 7B is adjusted in quantity and speed by the nozzles 41, and the low-boiling-point medium with the flow rate G2 is supplied through the sub-inlet 35 to the second radial turbine wheel 59, that is, the sub-path 55. The supplied low-boiling-point medium is decreased in pressure by the second radial turbine wheel 59 and flows into the through-channels 69. The low-boiling-point medium flowing into the through-channels 69 is further decreased in pressure and is supplied to the main path 57, where it is mixed with the low-boiling-point medium that is supplied from the main inlet 27 and that passes through the main paths 67.

The mixed low-boiling-point medium is discharged through the turbine wheel outlet 65 of the first radial turbine wheel 57. The low-boiling-point medium with a combined flow rate of the flows that pass through both of the paths causes the rotating shaft 13 to generate a rotational motive force via the first radial turbine wheel 57.

The rotational driving of the rotating shaft 13 causes the generator 9 to generate electric power.

Since a gap is provided between the main inlet 27 and the sub-inlet 35 such that the clearance between the back plate 26 of the main path 57 and the casing wall 53 is adjusted to be small, even if low-boiling-point media whose pressures differ are used, a low-boiling-point medium with a higher pressure flowing through the main inlet 27 can be prevented from leaking toward the sub-inlet 35, thus reducing leakage.

By supplying low-boiling-point media with different pressures from the binary cycles 7A and 7B to the main inlet 27 of the first radial turbine wheel 57 and the sub-inlet 35 of the second radial turbine wheel 59, respectively, in this way, a rotational motive force can be extracted by the integrated radial turbine wheels.

Thus, with the radial turbine 100 according to the second embodiment, the number of components can be decreased as compared with a plurality of expansion turbines or an expansion turbine equipped with a plurality of radial turbine wheels, thus decreasing the production cost.

In the second embodiment, as indicated by the arrows in FIG. 8, the low-boiling-point medium flowing through the sub-path 55 flows substantially in the axial direction, and the low-boiling-point medium flowing through the main path 67 flows in an inwardly inclined direction at the confluence portion of the low-boiling-point medium flowing through the main path 67 and the low-boiling-point medium flowing through the sub-path 55.

This may cause both the low-boiling-point media to collide, thus causing some mixing loss, even though it is slight.

Figure 9:
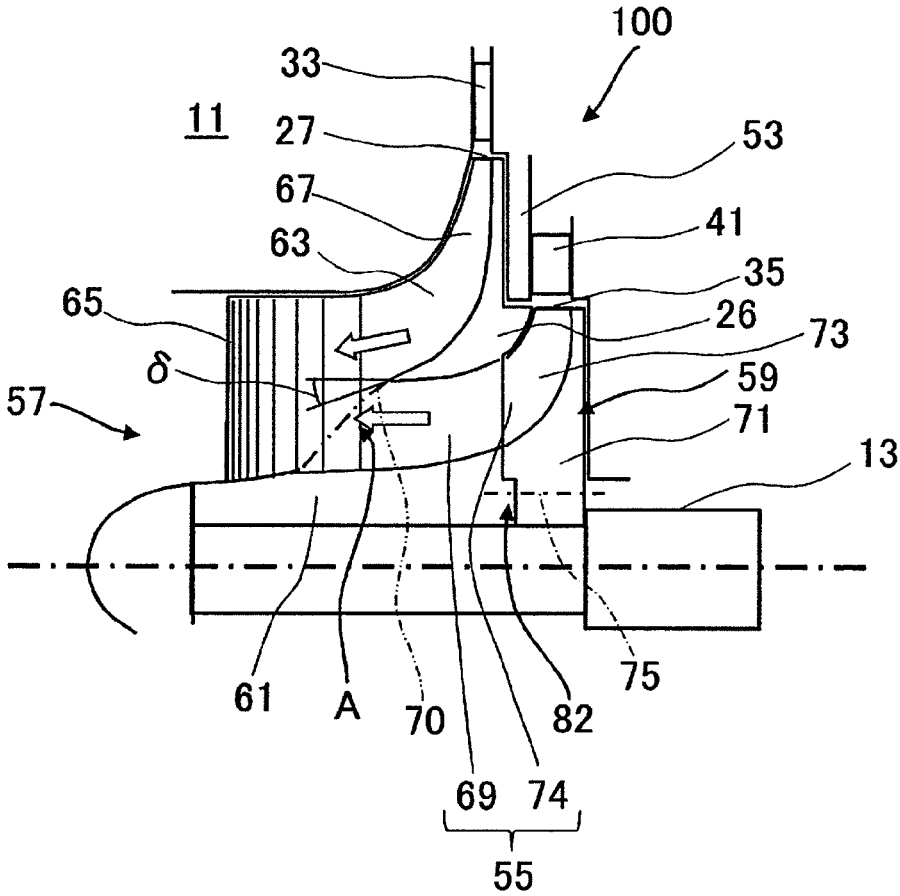
FIG. 9 is a partial sectional view showing another embodiment of the radial turbine according to the second embodiment of the present invention.

To eliminate this, for example, the inclination of the hub 61 at the confluence portion may be decreased so that the angle δ formed by the hub 61 surface and the radially outer surface of the through-path 59 is decreased, as shown in FIG. 9. Alternatively, the location where the main path 67 and the through-path 69 meet may be located downstream in the axial direction of the main radial turbine wheel 57 so as to decrease the angle δ.

Since this reduces the deviation in the flowing direction between the low-boiling-point medium flowing through the main path 67 and the low-boiling-point medium flowing through the sub-path 55, the mixing loss due to the collision can be reduced.

It is to be understood that the present invention is not limited to the embodiments described above, and various modifications may be made without departing from the spirit of the present invention.

REFERENCE SIGNS LIST

1 expansion turbine
11 casing
13 rotating shaft
15 radial turbine wheel
19 blade
23 main path
25 sub-path
26 back plate portion
27 main inlet
33 nozzle
35 sub-inlet
41 nozzle
53 casing wall
57 first radial turbine wheel
59 second radial turbine wheel
61 hub
67 main path
69 through-path
100 radial turbine

The invention claimed is:

1. A radial turbine equipped with a turbine wheel having a main path that gradually increases in blade height while curving from a radial direction to an axial direction, the turbine wheel converting swirling energy of fluid that flows therein while swirling from a main inlet located at the outer circumferential side into the main path, with a radial flow as a main component, to a rotational motive force and axially discharging the fluid that has released the swirling energy, wherein the turbine wheel has a sub-path branching off and extending from the hub surface of the main path, the sub-path being located at a position radially inward of the main inlet and rearward of the main path;

the sub-path has a sub-inlet that is located at a position in the radial direction different from the main inlet and at an outer circumferential end of the sub-path, and that is supplied with a fluid having a pressure different from the pressure of the fluid supplied through the main inlet; and the main inlet and the sub-inlet are partitioned by a gap adjusted between a back plate and a casing of the turbine wheel that constitute the main path.

2. The radial turbine according to claim 1, wherein the sub-path is formed such that blades that form the main path extend across the back plate.

3. The radial turbine according to claim 1, wherein the sub-inlet is inclined with respect to a rotating shaft.

4. The radial turbine according to claim 1, wherein the sub-path is constituted by a plurality of through-channels provided at a position corresponding to the main path so as to pass through the hub of the turbine wheel in the axial direction and a second turbine wheel disposed at the upstream side of the through-channels.

5. The radial turbine according to claim 4, wherein the second turbine wheel is fixedly mounted to the turbine wheel.

* * * * *